US008365715B2

(12) United States Patent
Toncelli

(10) Patent No.: US 8,365,715 B2
(45) **Date of Patent: *Feb. 5, 2013**

(54) COMBINED APPARATUS FOR MACHINING OF ARTICLES IN PARTICULAR IN FORM OF SLABS

(76) Inventor: Dario Toncelli, Bassano del Grappa (IT)

( * ) Notice: Subject to any disclaimer, the term of this patent is extended or adjusted under 35 U.S.C. 154(b) by 348 days.

This patent is subject to a terminal disclaimer.

(21) Appl. No.: 12/794,082

(22) Filed: Jun. 4, 2010

(65) Prior Publication Data

US 2010/0300424 A1 Dec. 2, 2010

Related U.S. Application Data

(63) Continuation of application No. 11/245,555, filed on Oct. 7, 2005, now Pat. No. 7,748,373, which is a continuation of application No. PCT/IT2005/000156, filed on Mar. 23, 2005.

(30) Foreign Application Priority Data

Oct. 20, 2004 (IT) ..... TV20040050 U

(51) Int. Cl.
*B28D 7/04* (2006.01)

(52) U.S. Cl. ..... 125/35; 451/57; 451/75; 451/88

(58) Field of Classification Search ..... 125/12, 125/13.01, 35; 451/57, 75; 83/170, 177, 83/658

See application file for complete search history.

(56) References Cited

U.S. PATENT DOCUMENTS

| | | | | |
|---|---|---|---|---|
| 3,634,975 A | | 1/1972 | Hensley | |
| 3,776,072 A | | 12/1973 | Gerber et al. | |
| 3,877,334 A | | 4/1975 | Gerber | |
| 4,112,797 A | | 9/1978 | Pearl | |
| 4,116,097 A | | 9/1978 | Graham et al. | |
| 4,204,448 A | | 5/1980 | Pearl | |
| 4,309,600 A | | 1/1982 | Perry et al. | |
| 4,312,254 A | | 1/1982 | Pearl | |
| 4,436,078 A | | 3/1984 | Bourke | |
| 4,738,174 A | | 4/1988 | Bloomquist | |
| 4,949,610 A | * | 8/1990 | Jones et al. | 83/177 |
| 5,003,729 A | | 4/1991 | Sherby | |
| 5,056,272 A | | 10/1991 | Battaglia | |
| 5,158,272 A | * | 10/1992 | Biervert et al. | 269/21 |
| 5,349,788 A | | 9/1994 | Nedo et al. | |

(Continued)

FOREIGN PATENT DOCUMENTS

| | | |
|---|---|---|
| CH | 677897 | 7/1991 |
| DE | 9202023 | 4/1992 |

(Continued)

OTHER PUBLICATIONS

International Search Report dated Jul. 26, 2005.

(Continued)

*Primary Examiner* — Dung Van Nguyen
(74) *Attorney, Agent, or Firm* — Katten Muchin Rosenman LLP

(57) ABSTRACT

An apparatus for machining an article (L) in the form of a slab or the like comprises—in addition to a rotary tool (24) associated with a spindle (22)—a nozzle (26) ejecting water at very high pressure. Both the rotary tool and the nozzle are supported by a carriage (20) sliding along a beam (18) in turn sliding along two shoulders (14) in a perpendicular direction. In the working area (12) and above a tank (30) normally filled with water, the article (L) is supported in a horizontal position not only by an interchangeable grid (32; 52), but preferably also by a disposable support (34) which prevent the rotary tool (24) from coming into contact with the grid. The disposable support is periodically replaced.

14 Claims, 6 Drawing Sheets

U.S. PATENT DOCUMENTS

| | | | | |
|---|---|---|---|---|
| 5,472,367 | A | 12/1995 | Slocum et al. | |
| 5,782,673 | A | 7/1998 | Warehime | |
| 5,921,228 | A * | 7/1999 | Watson | 125/13.01 |
| 5,934,346 | A | 8/1999 | Windeisen et al. | |
| 6,006,735 | A | 12/1999 | Schlough et al. | |
| 6,222,155 | B1 | 4/2001 | Blackmon et al. | |
| 6,299,510 | B1 | 10/2001 | Massenburg | |
| 6,306,015 | B1 | 10/2001 | Bushell | |
| 6,361,416 | B1 | 3/2002 | Hopkins et al. | |
| 6,375,547 | B1 | 4/2002 | Massenburg | |
| 7,748,373 | B2 * | 7/2010 | Toncelli | 125/35 |
| 2002/0028634 | A1 | 3/2002 | Massenburg | |
| 2005/0079797 | A1 * | 4/2005 | Marti et al. | 451/5 |

FOREIGN PATENT DOCUMENTS

| | | |
|---|---|---|
| DE | 4332630 | 3/1995 |
| DE | 19603933 | 8/1997 |
| DE | 29903578 | 6/1999 |
| DE | 19837132 | 11/1999 |
| DE | 69913680 | 9/2004 |
| EP | 0684340 | 11/1995 |
| EP | 1136215 | 9/2001 |
| FR | 2548073 | 1/1985 |
| JP | 55-125417 | 9/1980 |
| JP | 2003314998 | 11/2003 |
| WO | 2005014252 | 2/2005 |

OTHER PUBLICATIONS

Written Opinion of the International Searching Authority dated Jul. 26, 2005.

Non-final Office Action dated May 8, 2006 for corresponding U.S. Appl. No. 11/245,555.

Clarence R. Styron III, "A Preview of Methods for Cutting Concrete", Proceedings of the Second U.S. Water Jet Conference, May 24-26, 1983.

Non-final Office Action dated Jan. 16, 2007 for corresponding U.S. Appl. 11/245,555.

Final Office Action dated Oct. 26, 2007 for corresponding U.S. Appl. No. 11/245,555.

Non-final Office Action dated May 21, 2009 for corresponding U.S. Appl. No. 11/245,555.

Non-final Office Action dated Oct. 17, 2008 for corresponding U.S. Appl. No. 12/103,251.

Final Office Action dated Oct. 2, 2008 for corresponding U.S. Appl. No. 11/245,555.

Non-final Office Action dated May 7, 2008 for corresponding U.S. Appl. No. 11/245,555.

* cited by examiner

COMBINED APPARATUS FOR MACHINING OF ARTICLES IN PARTICULAR IN FORM OF SLABS

CROSS-REFERENCE TO RELATED APPLICATION

This application is a continuation of and claims priority to U.S. Ser. No. 11/245,555 filed in the U.S. on Oct. 7, 2005, which is pending, and which is incorporated by reference in its entirety for all purposes.

U.S. Ser. No. 11/245,555 is a continuation of International Application PCT/IT2005/000156, filed on Mar. 23, 2005, pending at the time of filing this continuation application, which claims priority from Italian Patent Application TV2004U000050 filed on Oct. 20, 2004, the contents of which are herein wholly incorporated by reference.

BACKGROUND OF THE INVENTION

The present invention relates to a combined apparatus for the machining of articles manufactured from solid stone, glass, ceramic and metallic materials. Even more specifically the present invention relates to a numerical control apparatus with interpolated axes for cutting, along straight and curved lines, articles in the form of slabs. It is understood that the reference to slabs made of natural stone, natural stone conglomerates and ceramic material in the remainder of this description does not have a limiting nature, but is only an example of articles which may be machined by the apparatus.

In the field of machining stone, glass, ceramic or metallic materials, numerical control apparatuses, known as bridge cutting machines, are known. By means of a spindle on which a tool consisting of a rotary disk is mounted, these apparatuses perform cutting of slabs into polygonal elements with straight sides.

Numerical-control cutting apparatuses with a gantry structure have recently been designed and manufactured, in which the cutting disk may also be inclined in any position between 0° and 90°, with the possibility of performing also incrementally inclined cuts.

In a typical configuration of these apparatus, the toolholder spindle is mounted on a beam which is enabled to perform a translatory movement with respect to the support surface and consequently with respect to the slab to be cut, while the spindle is in turn slidable along the beam, so that machining may be performed with considerable precision in the desired portion or portions of the slab.

An industrially important characteristic feature of these apparatus consists in the fact that very high cutting speeds together with a notable structural simplicity and equally notable mechanical strength may be obtained.

A problem hitherto unresolved of these numerical control gantry-type cutting apparatus is that of performing a transverse (either perpendicular or oblique) cut into polygonal elements having a size different from the parallel and adjacent strips resulting from the pass of the cutting disk in the longitudinal direction.

In fact, if the individual strips are engaged by the cutting disk in order to perform the transverse cut, at the end of the transverse cut of a first strip, the disk inevitably makes a nick in a second strip immediately adjacent to the first.

When the transverse cuts are not aligned in adjacent strips, it is obvious that the transverse cutting operation into elements of varying size may be performed only after separating the individual strips, removing them from the working surface or moving them away from each other the amount necessary such that the transverse cut of a strip does not also affect the immediately adjacent strip.

Also known is the technology of water-jet cutting of solid stone, glass, ceramic or metallic materials performed using apparatus where a jet of water emitted from a nozzle, movable along a controlled trajectory, is directed onto the surface of the article to be cut.

The water is emitted from the nozzle at a very high pressure (in the region of 3000-4000 bar) and, when it is required to cut hard materials, it is preferably mixed with suspended granules of abrasive materials.

Usually the material to be cut lays on a metal grid in turn mounted above a tank which is filled with water, said tank not only permitting the cutting water to be recycled, but also damping the violent impact of the jet emitted by the nozzle and passing through the material.

An advantageous characteristic feature of water jet cutting consists in the high cutting precision which allows the zone and extent of the cut to be determined in an exact manner: it is precisely because of this characteristic feature that water jet cutting apparatuses enable to perform cuts along profiles which are not straight.

Obviously, the use of water-jet cutting must be justified by particular machining requirements, in view of the higher operating cost.

There exist, however, situations and machining operations where it is desirable to be able to use both rotary-disk cutting technology and water-jet cutting technology. Hitherto this possibility may be realized only if both the apparatus in question are available.

In fact, it was not unusual, starting with a rough slab, to perform firstly longitudinal cuts, by means of which the slab is divided up into longitudinal strips having widths, which may also be different from each other. For this operation, the preferred tool is a rotary cutting disk and the apparatus used is a numerical-control cutting machine with a gantry structure.

Then it may be required to perform, for each strip, transverse cuts or also cuts not in a straight line, in particular along curved profiles, for which it is preferable to use a water jet cutting apparatus.

Finally, there exist intermediate situations where it is preferable to use both technologies and therefore both of said apparatuses for execution and completion of a same cut.

SUMMARY OF THE INVENTION

The main object of the present invention is to provide a combined apparatus which makes it possible to use both cutting technologies for machining slabs and other articles of the type mentioned above along straight and curved lines.

In order to process these articles, so-called contouring machines are known, which, by means of rotary tools mounted on a spindle, perform machining operations which range from polishing the surface of a slab to shaping and polishing the edges and also boring holes (e.g. in order to mount accessories such as taps and fittings) and/or provide zones which are formed and shaped within the thickness of the slab.

Another object of the present invention is to provide the possibility of performing in a single apparatus cutting operations, using both the abovementioned technologies, as well as machining operations of the present contouring machines.

These and other objects are achieved with a combined numerical control apparatus with interpolated axes for the machining of articles manufactured from solid stone, glass, ceramic or metallic materials, in particular in the form of slabs, having the characteristic features of the appended claim 1 and hence equipped with rotary tools as well as with a water jet.

In a preferred embodiment, the apparatus comprises a disposable support on which the article lays during machining, said disposable support being in turn rested on a grid arranged above a tank which is normally full of water.

The apparatus according to the present invention may be independent (stand alone) or may be incorporated into a processing line, the characteristic features of which are also claimed hereinbelow.

The main advantage of the combined apparatus according to the present invention consists in that it is able to perform machining operations using both the technologies mentioned above, without being subject to the costs and the drawbacks associated with the use of two separate machines. In particular, when it is required to perform and complete a same cut using both technologies, the downtime is eliminated, the risks of damaging the articles during transfer from one machine to another are eliminated and the quality of the finished products is improved since it is no longer necessary to newly setting-up the article, which remains mounted on the same support.

More specifically, the apparatus according to the invention offers the following advantages:

- the possibility of performing broad working strokes, of up to 3500×2100 mm;
- the possibility of alternating diamond-disk cutting with water-jet cutting, with optimum use of both cutting techniques;
- a high cutting precision;
- a reduction in the machining waste and reject material;
- the execution of interpolated curved cuts.

BRIEF DESCRIPTION OF THE DRAWINGS

Other aspects and advantages of the apparatus according to the invention will emerge more clearly from the description which follows of a preferred, but not exclusive embodiment with reference to the accompanying drawings in which.

DETAILED DESCRIPTION OF THE INVENTION

Figure 1:
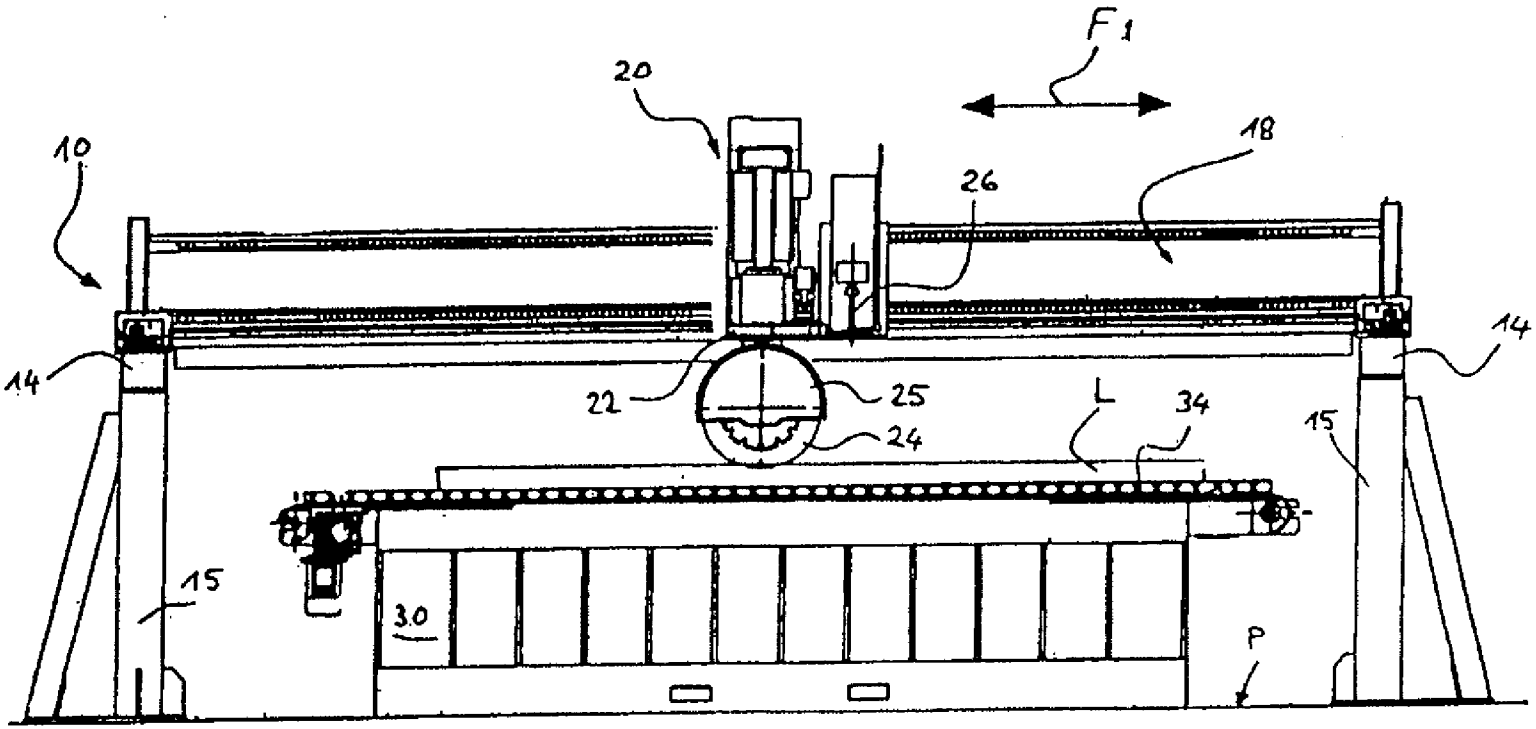
FIG. 1 is a front view of a apparatus according to the invention.
Figure 2:
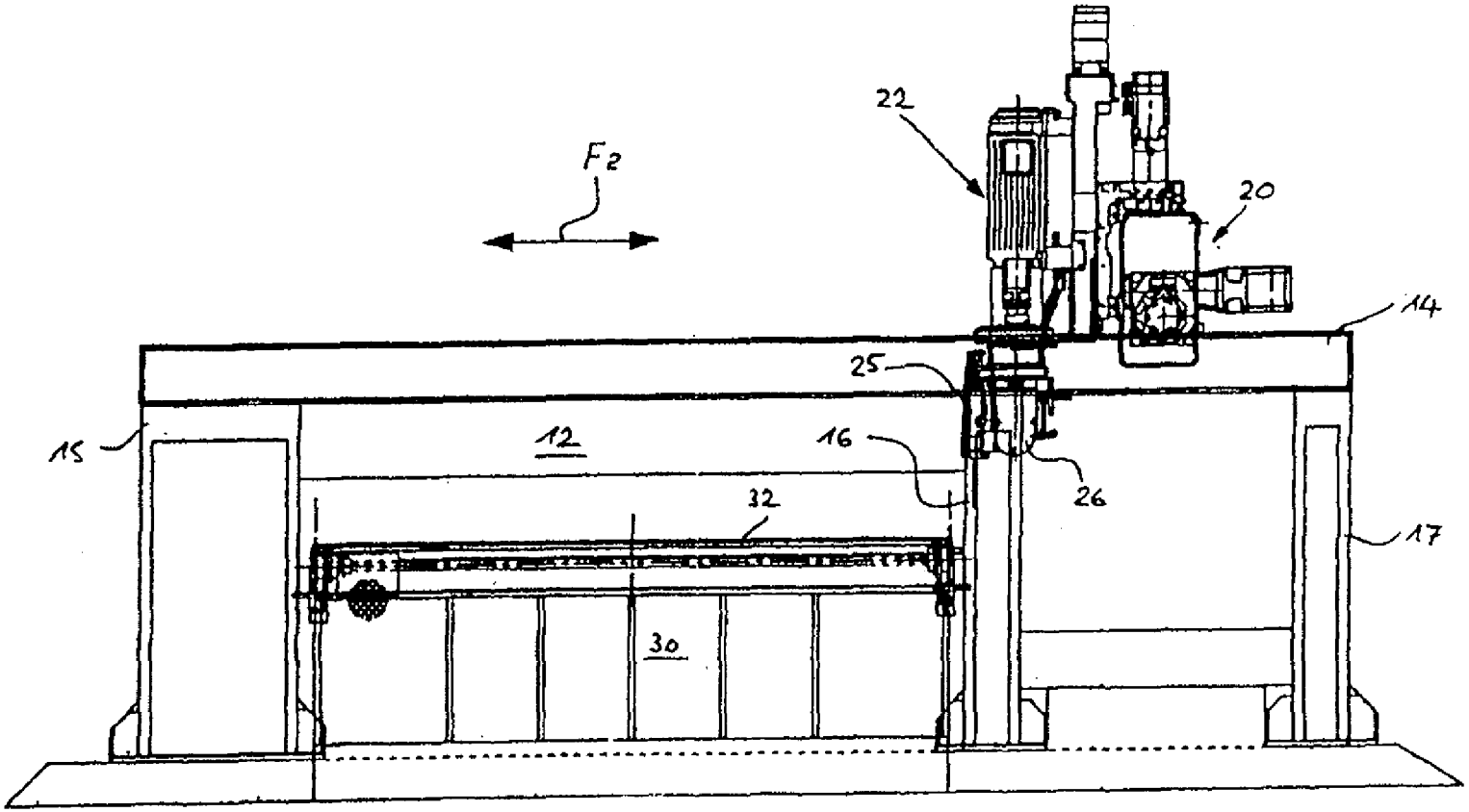
FIG. 2 is a side view of the apparatus shown in FIG. 1.
Figure 3:
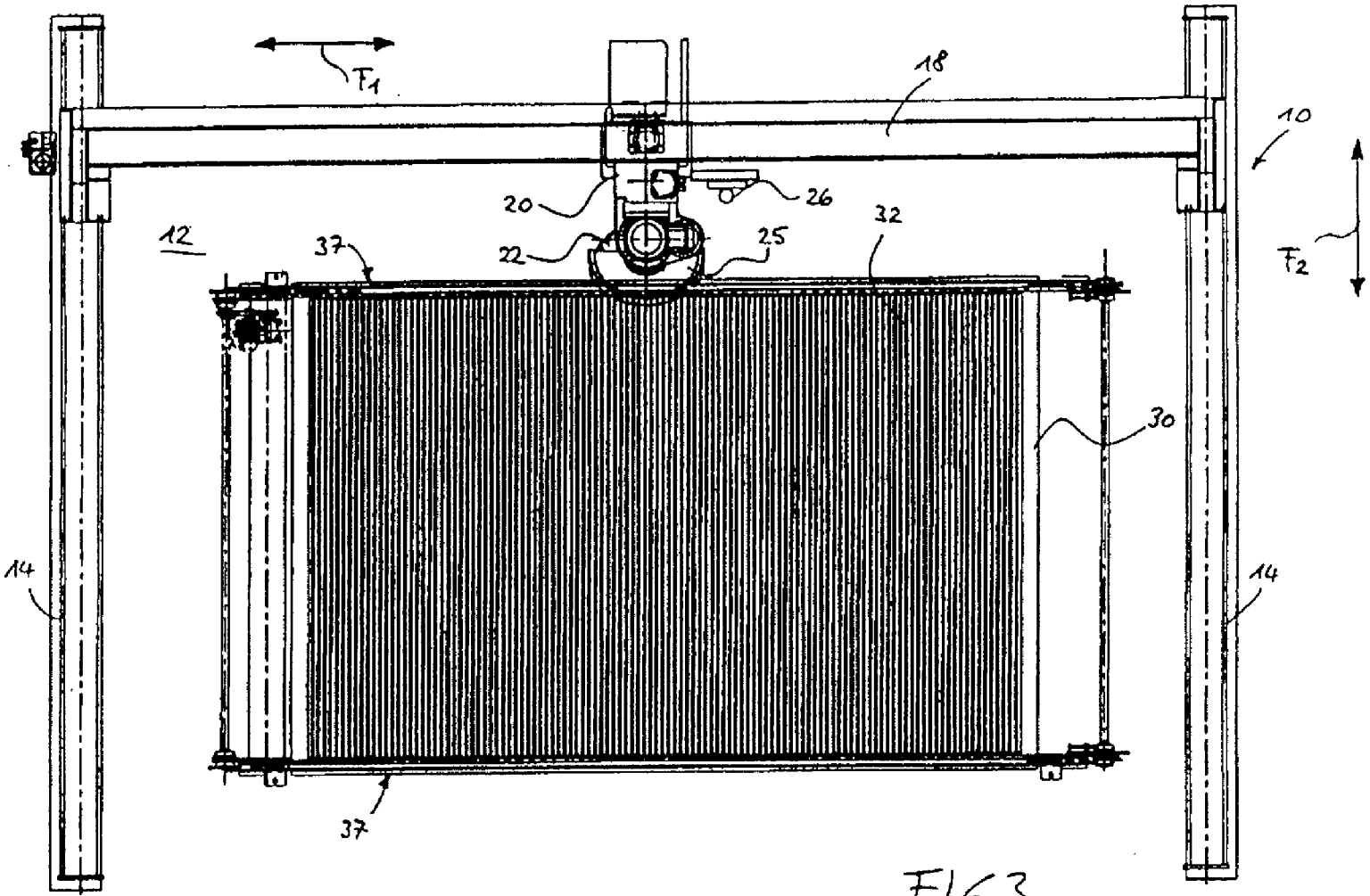
FIG. 3 is a top plan view of the apparatus shown in FIGS. 1 and 2.

In FIGS. 1-3, the reference numeral 10 denotes overall the stationary structure of a combined numerical-control apparatus with interpolated axes for the machining of articles manufactured from stone, glass, ceramic or metallic materials, in particular articles in the form of slabs, the apparatus being in accordance with the present invention. The reference numeral 12 denotes the space or working area delimited by the structure 10, which is of the gantry type being substantially formed by two side shoulders 14 which are secured to the floor P through a plurality of pillars 15, 16 and 17 and a longitudinal beam 18 which is movable transversely with respect to the working space 12 in the direction of the double arrow $F_2$ in FIGS. 2 and 3.

The beam 18 has, mounted thereon, a motor-driven carriage 20 which supports a spindle 22 on which a rotary cutting disk 24 provided with a protective cowling 25 is mounted. The carriage 20 has the possibility of sliding longitudinally with respect to the working space 12, namely in the direction of the double arrow $F_1$, this direction being perpendicular to the direction $F_2$ and also horizontal (see FIGS. 1 and 3). The spindle 22 is per se well-known, being of the type used in numerical control gantry-type cutting machines with interpolated axes which are present on the market (for example the machines of the series "Speedycut" and "Joycut" made and marketed by Breton SpA, Italia). Obviously the spindle 22 is connected to motor means, for example of the so-called brushless type, so as to bring the cutting disk 24 into the operative position and to retract it upwards when it is not engaged with the slab L being machined (the slab L is shown for the sake of simplicity only in FIG. 1).

Since the components described hitherto are those conventionally used in diamond-disk cutting machines, it is not required in this description to provide further explanations and/or details relating to their construction and operation, including the details relating to the motors which perform the displacements of the beam 18 in the direction $F_2$ or of the spindle-support carriage 20 in the direction $F_1$ as well as the movements of the spindle 22 and operation of the cutting disk 24, nor the details of the motor control means.

According to a characteristic feature of the invention, a nozzle 26 for emitting a jet of cutting water is also mounted on the spindle-support carriage 20. An actuator, not shown, for example a hydraulic cylinder, displaces the nozzle 26 from a raised rest position into a lowered operative position, shown in broken lines in FIG. 6.

The nozzle 26 is connected to an unit 28 (shown only schematically in FIG. 4 since it is also well-known in the art of water jet cutting machines) which supplies the nozzle 18 with water under very high pressure (as already mentioned in the range of 3000-4000 bar) and abrasive sand, via connection pipes 29.

The mobility of the spindle-support carriage 20 along the beam 18 (double arrow $F_1$) and of the latter in the transverse direction with respect to the working area 12 along the two side shoulders 14 (arrow $F_2$) ensure that both the cutting disk 24 and the nozzle 26 may be positioned in vertical alignment with any point of the horizontal surface which delimits at the bottom the working area or space 12.

The apparatus according to the invention comprises, inside said zone 12, a tank 30—intended to be filled with water—which is typical of water jet cutting machines and is covered by an interchangeable grid 32 (see FIG. 1) on which the article, i.e. the slab L, lays during machining.

In the preferred embodiment of the invention which is described here, a disposable support 34 is arranged between the grid 32 in the lower position and the slab L in the upper position, said support having the function of preventing the cutting disk 24 from coming into contact with the grid 32 during operation thereof. The disposable support 34 consists of a flat board preferably made of material such as wood and having a thickness in the range of 3-4 mm. Along the two perimetral side edges the board 34 is provided with equidistant holes 35 for the purposes mentioned further below.

Usually, the cutting disk 24 protrudes by about 1 mm from the bottom side of the slab L so that, after each cutting pass with the disk 24, the disposable board 34 will be cut into over a depth of about 1 mm, thus being able to be used for at least 3 or 4 successive slabs when machining envisages solely use of the disk 24.

When, after cutting by means of the disk 24, cutting by the water jet from the nozzle 26 is performed, it is obvious that the disposable board will be bored and partially cut by the water jet. Therefore, in this case, the maximum limit of reuse of the disposable board 34 is dependent upon the degree of weakening resulting from the water jet cutting action. The grid 32 is instead cut into only partially, so that its replacement takes place less frequently.

Figure 8:
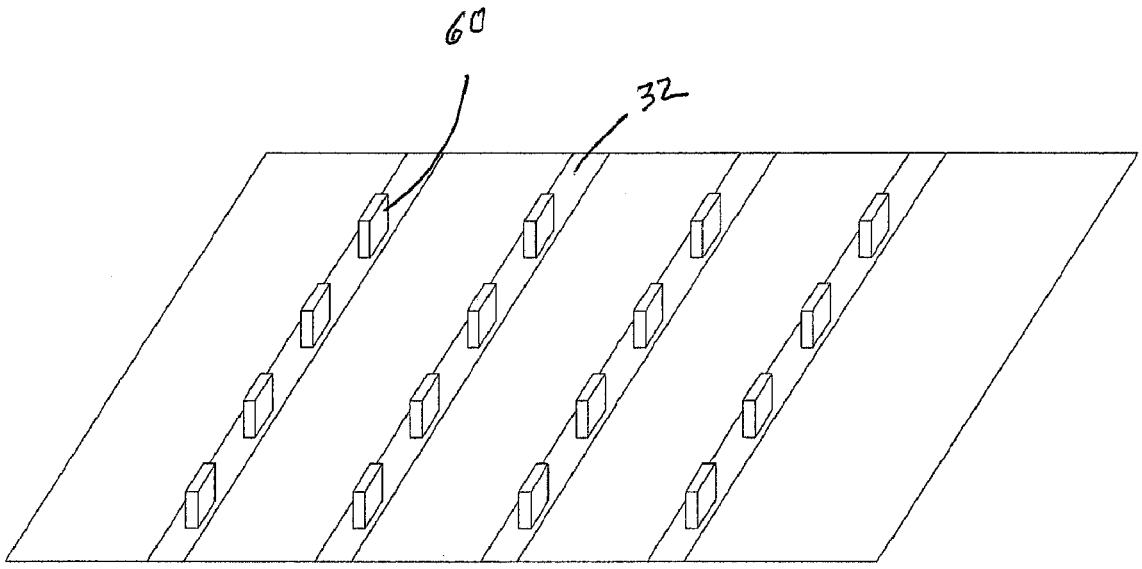
FIG. 8 is a top view of a portion of the apparatus showing the presence of lugs.

The disposable support can advantageously consist, instead of a wooden board, in a series of interchangeable lugs 60 of plastic material, for example of a length of 10 mm, which are inserted on top of the grid 32 (which is shown unloaded above the tub 30, for a sake of simplicity in FIG. 8). In this manner the slab L is raised with respect of the grid so that the latter is not damaged, or is only partially damaged, during the machining operations, of course, also said lugs are subject to periodical replacement.

If we now consider other parts which (together with the combined apparatus according to the invention described hereinabove) are present in a first plant for processing articles in the form of a slab, FIGS. 4 and 5 clearly show a first rollerway 40 and a second rollerway 45. A disposable board 34 is positioned onto the first rollerway 40, which is positioned upstream of said combined apparatus, and the slab L to be machined is in turn positioned onto the disposable board 34 (see FIG. 5). The lateral peripheral edges of the board 34 are provided with equidistant apertures for the purposes mentioned further below.

By means of sliding on said first rollerway 40, which extends as far as the inside of the working area 12, the front edge of the board 34 reaches the upstream end of the grid 32. In this condition the holes 35 along the two side edges of the board 34 are engaged by means able to convey the board in a controlled manner, for example the pins projecting upwards from a pair of parallel chains 37 which extend above the tank 30. The disposable board 34 and the slab L onto the board are thus transferred onto the grid 32 above the tank 30 so that the slab undergoes the desired machining operation by means of the cutting disk 24 and/or the jet emitted by the nozzle 26 (see FIG. 4).

Preferably, before entering into the working area 12, the slab L is analysed by scanning means (of the known type and not shown) which check on the one hand the shape of the slab edges and on the other hand whether there are any flaws, micro-fissures, scratches or other defects in the slab.

Once machining has been completed in the zone 12, the slab L, which is now divided into a plurality of articles which are cut, but still be supported by the disposable board 34 (the latter, as mentioned above, not being shown for the sake of simplicity), is transferred in the same manner as already described onto the second rollerway 45 which forms the unloading station. From said second rollerway 45, the individual articles are conveyed to a final destination or transferred to other machining stations, while the disposable board 34, if it can be reused, is positioned again on the first rollerway 40 so as to receive a new slab to be machined. Periodically, namely when it is excessively damaged by the action of the cutting disk 24 and/or the jet emitted from the water emission nozzle 26, the disposable board 34 is replaced.

Figure 6:
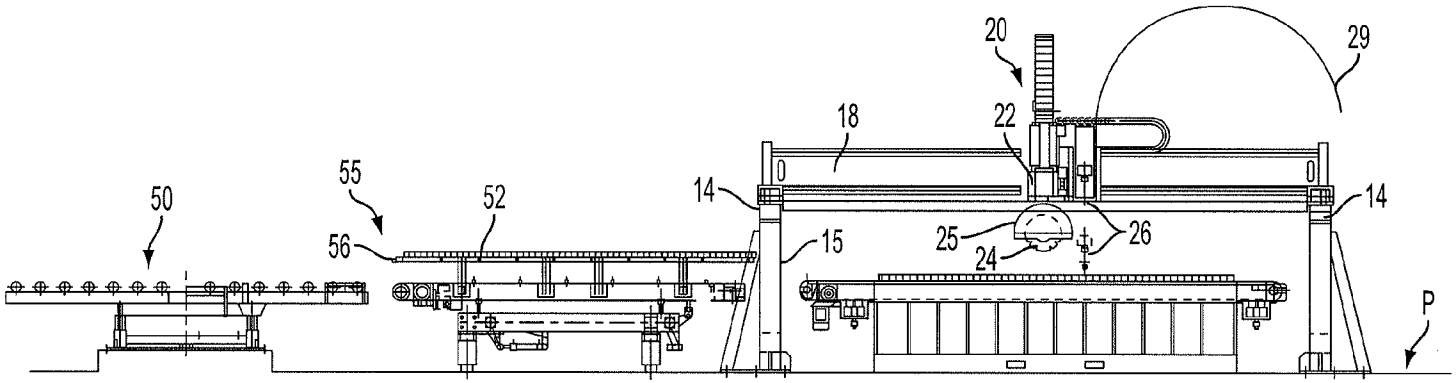
FIG. 6 is a partial side view of another plant for processing slabs comprising a apparatus according to FIGS. 1-3.
Figure 7:
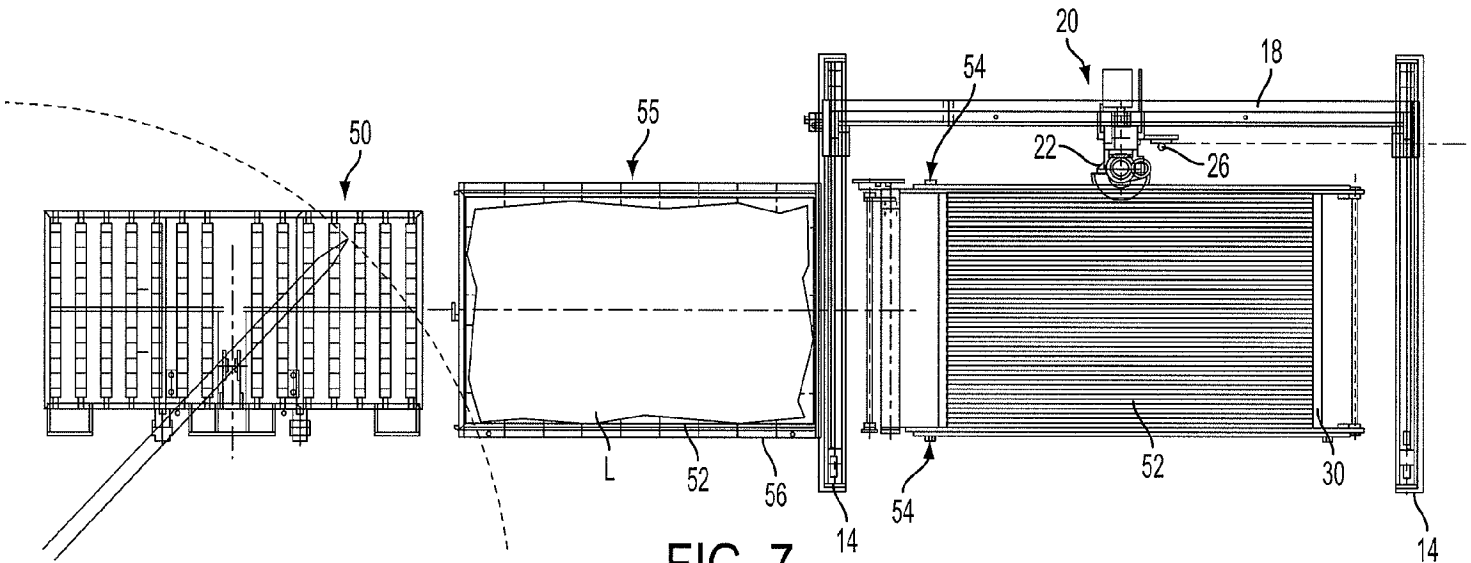
FIG. 7 is a partial top plan view of the plant according to FIG. 6.

FIGS. 6 and 7 show a second plant for processing articles in form of slab which comprises, upstream of the apparatus according to the invention, a rollerway 50 and a system 55 for loading a slab into the working area 12 and unloading the cut articles from the said zone. The loading and unloading system 55 consists of a conveyor equipped with a lifting device designated by the reference numeral 56 and shown in its raised position in FIG. 6.

A pallet (consisting from the bottom upwards by a metal grid 52 having a supporting frame, a disposable support and a slab L) is fed to the system 55 by the rollerway 50.

Said pallet is then transferred by the conveyor of the system 55 into the working area 12 above the tank 30, by simple means like motorized chains 54. While the slab L is machined, a second pallet (identical to the first one) is fed by the rollerway 50 and is subsequently raised by the lifting device 56. The cut articles are then unloaded, together with the grid and any disposable support, onto the lower level of the system 55 and definitively removed from the plant by the rollerway 50. In the meantime, the second pallet is brought to the lower level of the system 55 by the lifting device 56 and subsequently moved into the working area 12, above the tank 30, as already described.

Figure 4:
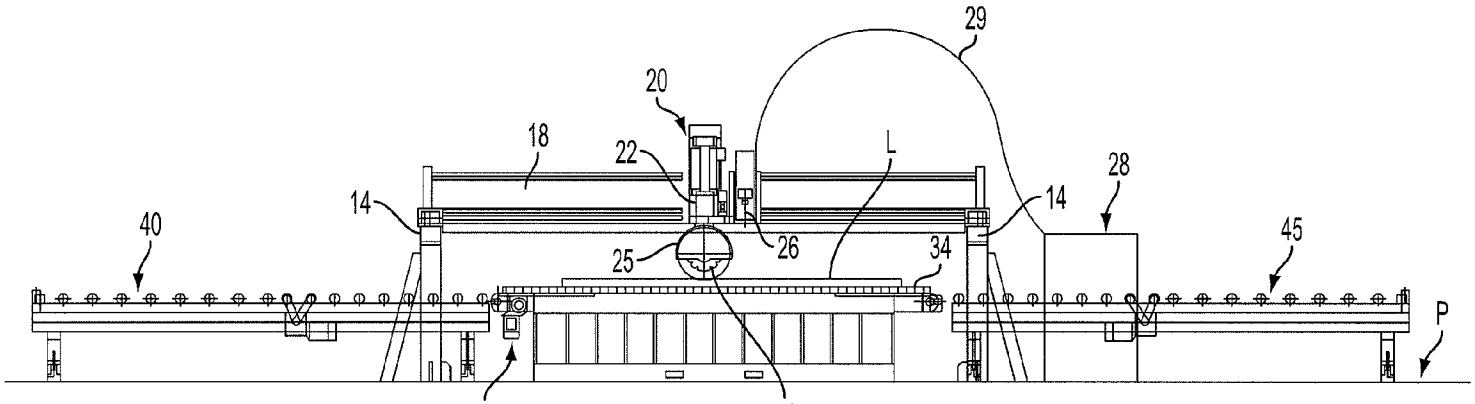
FIG. 4 is a partial side view of a plant for processing slabs comprising a apparatus according to FIGS. 1-3.
Figure 5:
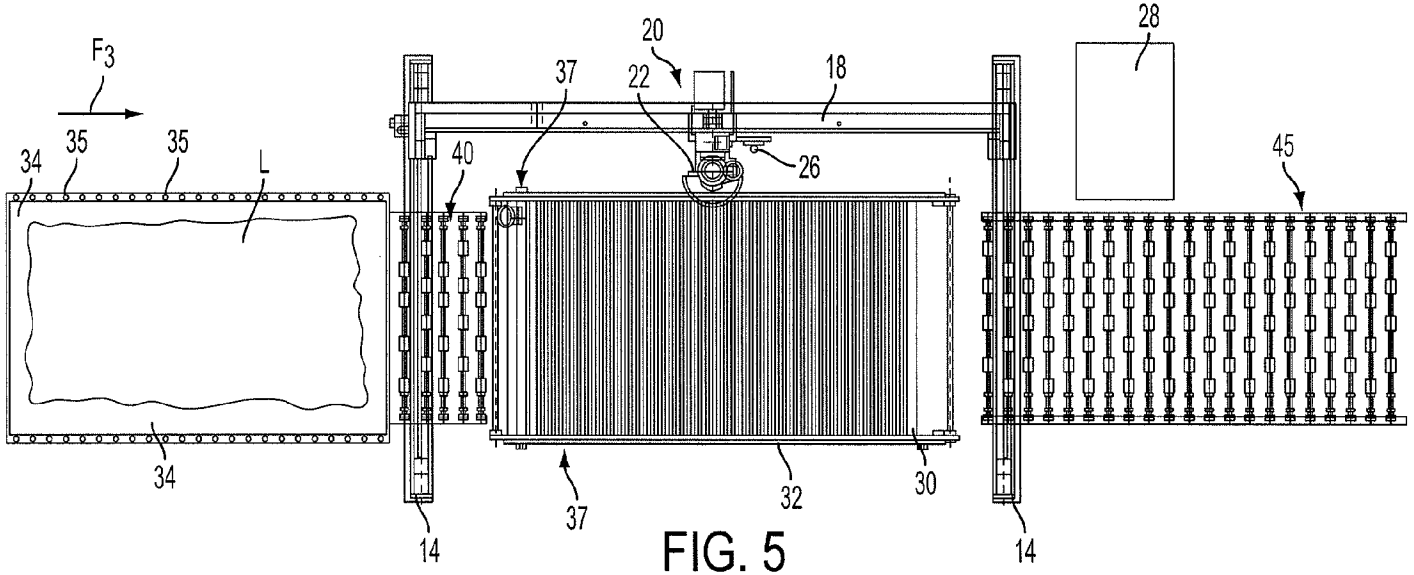
FIG. 5 is a partial top plan view of the plant according to FIG. 4.

Compared to the plant shown in FIGS. 4 and 5, in the plant shown in FIGS. 6 and 7 the unloading and loading of the pallets takes on the same side of the apparatus instead of two opposite sides, thus avoiding to make longer the path of the disposable support for reuse.

From the above description the advantages which are achieved by the present invention may be clearly understood.

Firstly, a multi-functional and simplified apparatus is provided since, compared to the two original machines, many duplicate components have been eliminated with obvious savings in cost terms.

Secondly, the downtime which would inevitably occur when using two separate machines has been minimized. In fact, when machining operations using either one or other technology must be performed on the same article, it is sufficient to use in succession the cutting disk and the ejector nozzle.

Obviously modifications and variations are possible and may be envisaged without departing from the scope of the appended claims. In particular, other types of rotary tools, for example for performing holes, chamfers, undercuts, shaping, etc., namely tools which are typical of contouring machines, may be mounted on the spindle of the combined apparatus. In this case the apparatus will be suitably equipped with well-known tool-storage means.

What is claimed is:

1. A combined numerical-control apparatus, with interpolated axes, for machining an article manufactured from solid stone, glass, ceramic or metallic materials, in particular a slab, the apparatus comprising:

a frame delimiting a working area of the article and formed by two shoulders and a beam perpendicular the shoulders and slidable along the shoulders;

a spindle and an associated rotary tool movable vertically to engage the article within the working area;

a carriage sliding along the beam for supporting the spindle, the carriage being movable in a controlled manner with respect to the article in two horizontal directions perpendicular to each other;

a water emission nozzle for water cutting, the nozzle supported by the carriage;

a tank normally full of water inside the working area;

means for bringing the water to the desired pressure;

means for supplying the water emission nozzle with the water;

a support assembly for supporting the article in a horizontal position during machining within the working area above the tank, wherein the support assembly for supporting the article during machining within the working area, above the tank, consists of an interchangeable grid and a disposable support arranged between the grid and the article, the disposable support for preventing the rotary tool from coming into contact with the grid.

2. The combined apparatus according to claim 1, wherein the disposable support is made in non-metallic material.

3. The combined apparatus according to claim 1, wherein the disposable support is inserted on top of the grid.

4. The combined apparatus according claim 1, wherein the disposable support consists of a wooden board able to lay onto the grid.

5. The combined apparatus according claim 4, wherein the wooden board has a thickness of 3-10 mm.

6. The combined apparatus according to claim 1, wherein the disposable support consists of a series of interchangeable plastic lugs.

7. The combined apparatus according claim 1, wherein the water emission nozzle is supported by the movable carriage for moving vertically independently from the spindle.

8. The combined apparatus according claim 1, further comprising a pair of long conveyors arranged parallel above the tank and able to transfer and maintain the article onto the disposable support during machining and to unload, at the end of machining, the resultant articles.

9. The combined apparatus according to claim 1, wherein the rotary tool associated with the spindle is a cutting disk.

10. The combined apparatus according to claim 1, wherein the cutting disk may be inclined between 0° and 90°, for performing full pass and incremental cuts, and is rotatable about a vertical axis of the spindle for performing interpolated oblique cuts.

11. The combined apparatus according to claim 1, further comprising a store for various rotary tools which can be mounted on the spindle for machining the article.

12. A plant for processing articles in the form of a slab, the plant comprising:

a combined apparatus, the combined apparatus comprising a frame delimiting a working area of the article and formed by two shoulders and a beam perpendicular the shoulders and slidable along the shoulders;

a spindle and an associated rotary tool movable vertically to engage the article within the working area;

a carriage sliding along the beam for supporting the spindle, the carriage being movable in a controlled manner with respect to the article in two horizontal directions perpendicular to each other;

a water emission nozzle for water cutting, the nozzle supported by the carriage;

a tank normally full of water inside the working area;

means for bringing the water to the desired pressure;

means for supplying the water emission nozzle with the water;

support assembly for supporting the article in a horizontal position during machining within the working area above the tank, wherein the support assembly for supporting the article during machining within the working area, above the tank, consists of an interchangeable grid and a disposable support means arranged between the grid and the article, the disposable support for preventing the rotary tool from coming into contact with the grid;

a conveyor for ensuring the transfer of the article, arranged above the disposable support into the working area of the combined apparatus above the tank and the removal of the resultant articles.

13. The plant according to claim 12, wherein the conveyor comprises a first rollerway arranged upstream of the combined apparatus and a second rollerway arranged downstream.

14. The plant according to claim 12, wherein the conveyor consists of a loading and unloading system arranged at only one side of the combined apparatus and comprising a lifting device able to receive and to move to and from the working area of the combined apparatus a couple of pallets consisting from the bottom upwards by a metal grid having a supporting frame, the disposable support and an article to machine, with the result that, while a first pallet is positioned within the working area, a second pallet is arranged and that, when the pallet is removed from the working area, the second pallet is transferred into the same working area.

* * * * *